US007350771B2

(12) United States Patent
Andersen

(10) Patent No.: US 7,350,771 B2
(45) Date of Patent: Apr. 1, 2008

(54) GEAR FOR ELECTRICALLY/HYDRAULICALLY AND MANUALLY DRIVEN SHEET WINCHES

(75) Inventor: Frode Andersen, Vejle (DK)

(73) Assignee: Frederik Andersens Maskinfabrik A/S, Vejle (DK)

( * ) Notice: Subject to any disclaimer, the term of this patent is extended or adjusted under 35 U.S.C. 154(b) by 121 days.

(21) Appl. No.: 10/565,790

(22) PCT Filed: Jul. 9, 2004

(86) PCT No.: PCT/DK2004/000493

§ 371 (c)(1),
(2), (4) Date: Jan. 25, 2006

(87) PCT Pub. No.: WO2005/009887

PCT Pub. Date: Feb. 3, 2005

(65) Prior Publication Data

US 2006/0231816 A1 Oct. 19, 2006

(30) Foreign Application Priority Data

Jul. 29, 2003 (DK) ..... 2003 01111
Sep. 10, 2003 (DK) ..... 2003 01300

(51) Int. Cl.
*B66D 1/22* (2006.01)

(52) U.S. Cl. ..... 254/344; 254/346

(58) Field of Classification Search ..... 254/342, 254/344, 345, 346
See application file for complete search history.

(56) References Cited

U.S. PATENT DOCUMENTS

| | | | | |
|---|---|---|---|---|
| 4,350,109 | A | 9/1982 | Tattersall | |
| 5,368,279 | A * | 11/1994 | Ottemann et al. | 254/342 |
| 6,029,952 | A * | 2/2000 | Huggett et al. | 254/344 |
| 6,036,174 | A | 3/2000 | Andersen | |
| 6,042,086 | A * | 3/2000 | Roberts | 254/344 |
| 6,070,858 | A | 6/2000 | Hase et al. | |
| 6,776,397 | B2 * | 8/2004 | Vado et al. | 254/342 |

* cited by examiner

*Primary Examiner*—Emmanuel M Marcelo
(74) *Attorney, Agent, or Firm*—James Creighton Wray; Clifford D. Hyra

(57) ABSTRACT

By modern gears for electric/hydraulic and manually driven sheet winches, demands are made on the presence of a free-wheeling mechanism (24) in case that the drive unit fails, and it is also desirable that the gear takes up as little space as possible, irrespectively whether it is placed on deck or below on a boat. Thus there is indicated a gear of the kind indicated which is peculiar in that the planet carrier (22) is suspended on roller/ball bearings disposed farther away from the center axis (12) of the planet carrier than the free-wheeling mechanism (24). This design enables reducing installation dimensions for the gear, as the normally used central shaft may be omitted and the space can be utilised for placing the free-wheeling mechanism (24).

6 Claims, 3 Drawing Sheets

GEAR FOR ELECTRICALLY/HYDRAULICALLY AND MANUALLY DRIVEN SHEET WINCHES

This application claims the benefit of Danish Application No. PA 2003 01111 filed Jul. 29, 2003, Danish Application No. PA 2003 01300 filed Sep. 10, 2003 and PCT/DK2004/000493 filed Jul. 9, 2004, which are hereby incorporated by reference in their entirety.

The present invention concerns a gear for electrically/hydraulically and manually driven sheet winches, including a drive shaft housing connected with a gear housing, where the drive shaft housing includes a drive shaft connected with a rotatably suspended planet carrier with a number of planet wheels rotatably suspended on a number of planet pinion spindles corresponding to the number of planet wheels, the planet pinion spindles being anchored in the planet carrier and distributed about a common centre axis for the drive shaft and the planet carrier, where the planet wheels interact with a toothed rim situated at the underside of the gear housing, the drive shaft driven to one-way rotation in a given direction by insertion of a rotor hub interacting with the planet wheels on an electric/hydraulic drive unit, and where between the drive shaft and the planet carrier there is provided a free-wheeling mechanism.

Such gears/gear housings are well-known and are used as intermediate links between a sheet winch and the drive unit used for driving the sheet winch, in order to provide a high gearing between the drive unit and the sheet winch with regard to keeping the operating power of the drive unit at a relatively low level. Another and very important safety function of such gears/gear housings is that these are to provide a free-wheeling function so that the sheet winch, in case of breakdown of the drive unit, failure of the energy supply for the latter or similar, may be continually operated manually by fitting a crank handle on the upwards facing end of the sheet winch.

The relevant gears may either be mounted on deck or below on a relevant boat, and there are different designs of the gear housings, depending on the selected gear design. E.g. there is known a version where the shaft of the drive unit is connected with a worm drive, the worm wheel of which, via a shaft connection with a free-wheeling mechanism within the gear housing passed through an opening in a deck plate mounted upon the boat deck, is connected with the drive wheel at the underside of a sheet winch anchored to the deck plate. For space reasons, the worm wheel version is only suited for mounting below, but in some cases, the space conditions below are so tight that other types of gears/gear housings are preferred which have a relatively small installation height.

As alternative to the worm gear housing, a planet gear can be used at the underside of which the drive unit, which is often constituted by an electric motor, is mounted so that the drive shaft of the electric motor is connected to a sun wheel driving the planet wheels. The planet gear, which has better efficiency than the worm gear, will be space saving compared with the worm gear by mounting below. Furthermore, the planet gear additionally has the advantage that this and the electric motor may be placed upon the deck, immediately under the sheet winch, alternatively below, but while taking up less space than the worm gear. Particularly when mounting upon the deck but also in connection with mounting below, it is decisive that the said winch, including the gear housings and the drive units in connection thereto, is taking up the least possible space. As the diameters of the planet gear housings are determined on the basis of a preferred gearing and the dimension of the sheet winch intended to be driven by the drive unit, hardly any consideration may be given to reducing the gear housing diameter. This means that the installation height becomes a very significant factor. In that connection it is to be recalled that hitherto some limitations concerning the possibilities of reducing the installation height have existed, as space is to be provided for the free-wheeling function for disengagement/free-wheeling for the drive shaft together with the planet gear. The planet carrier is normally rotatably suspended about a centre shaft, entailing a rather large installation height due to the presence of the free-wheeling device for the drive shaft and the bearing around which the planet carrier rotates.

SUMMARY OF THE INVENTION

The present invention has the purpose of providing a planet gear of the kind indicated where the gear housing is designed so that the installation height may be substantially reduced compared with commonly known types of planet gears that are used together with electric/hydraulically and manually powered sheet winches.

This purpose is achieved with a gear of the kind indicated in the introduction which is characterised in that the planet carrier is suspended on roller/ball bearings disposed farther away from the centre axis of the planet carrier than the free-wheeling mechanism.

Hereby is achieved that the installation height of the planet gear may be reduced as a result of the possibility of the free-wheeling mechanism and the roller/ball bearings for the planet carriers may be disposed opposite each other, in contrast to the prior art planet carriers, where the free-wheeling mechanism and the roller/ball bearings are disposed over each other. Besides, the central shaft is made redundant resulting from the ball/roller bearings for the planet carrier being located elsewhere, providing possibility of disposition of the free-wheeling unit at the central area of the planet carrier. By the central shaft being made redundant, the weight of the gear housing is reduced correspondingly.

In an embodiment of the planet gear according to the invention, the planet carrier may be suspended on roller/ball bearings on the external periphery of the planet carrier and farther away from the centre axis of the planet carrier than the attachment points for the planet pinion spindles in the planet carrier, and preferably at the same level as the said attachment points.

In a further embodiment of the planet gear according to the invention, the planet carrier may be suspended on roller/ball bearings disposed at the outer periphery of the planet carrier and closer to the centre axis of the planet carrier than the attachment points of the planet pinion spindles in the planet carrier.

Both of the further embodiments contains the same possibility of attaining reduced installation height of the planet gear housing, as the bearings for the rotatable suspension of the planet carrier are disposed at the outer periphery of it, and preferably at the same level of the free-wheeling mechanism, whereby the central shaft on which the roller/ball bearings of the planet carrier are normally suspended is made superfluous.

Rollers/balls that constitute one half of the bearings placed on the periphery of the planet carrier, are supported/guided in grooves in relevant facing parts of the gear housing and may also in some cases be supported in a groove running in the transition between the gear housing and the drive shaft housing, as specified in claims 4 and 5.

Without abandoning other embodiments of the bearings, it is to be mentioned that the balls/rollers may advantageously be constituted by a combination of materials so that every other ball/roller is made of steel, and every other is made of synthetics, e.g. Del-rin.

The gear housing according to the invention provides a possibility of reducing the installation height considerably, which is particularly of great significance in cases where the gear housing and the drive unit is mounted on sheet winches mounted upon the deck of a boat, where space is tight already and where persons handling sails and ropes are walking.

The invention is explained more closely in the following with reference to the drawing, where:

DETAIL DESCRIPTION OF THE PREFERRED EMBODIMENTS

Figure 1:
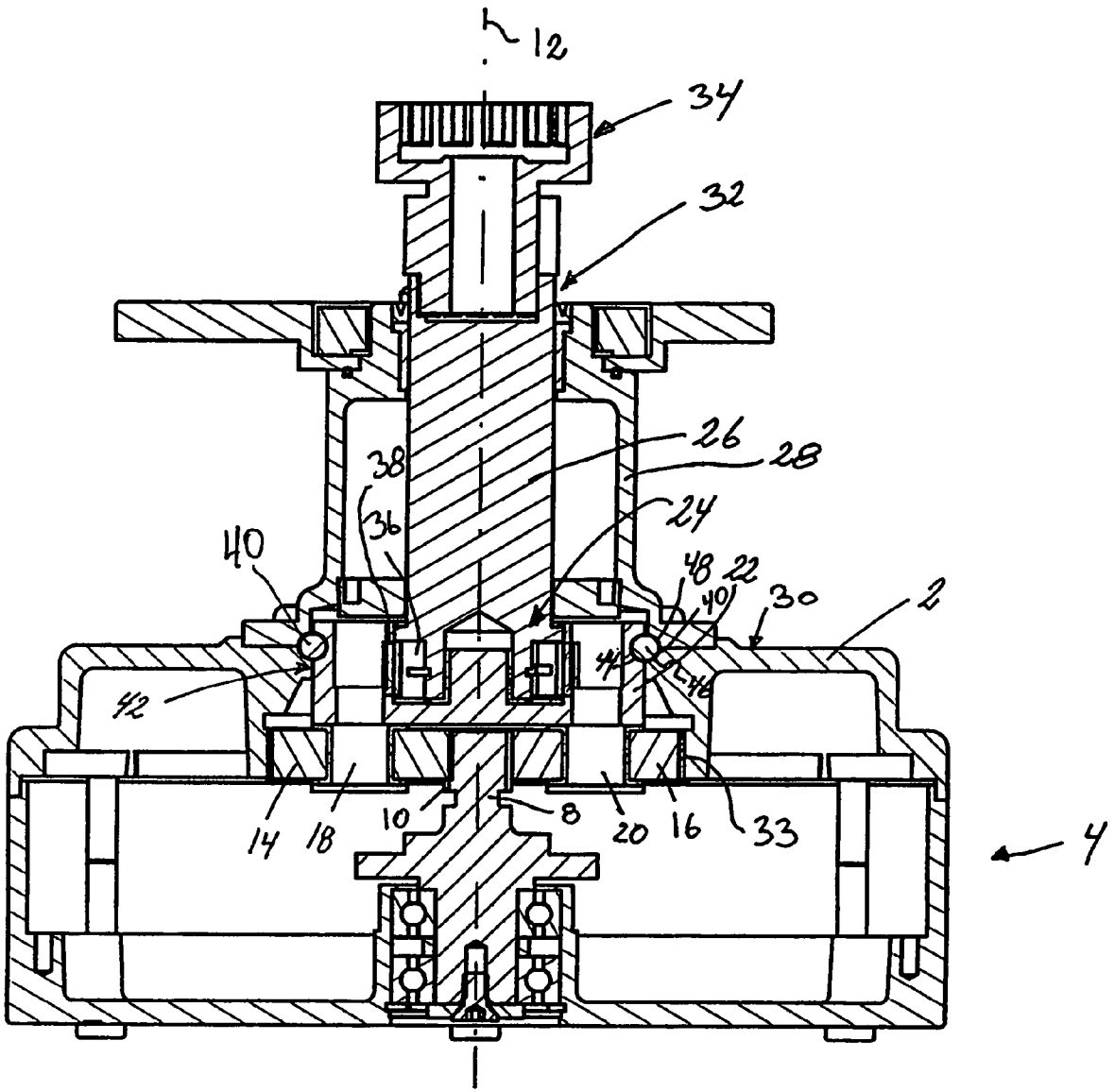
FIG. 1 is a sectional side view of a first embodiment of a gear housing for electric/hydraulic and manually driven sheet winches according to the invention for mounting below.

In FIG. 1 is seen a sectional side view of a first embodiment of a gear housing 2 for electric/hydraulic and manually driven sheet winches (not shown) according to the invention for mounting below (not shown). On FIG. 1 is furthermore shown a drive unit 4 in the shape of an electric motor, the drive shaft 8 of which including a sun wheel 10 disposed at the centre axis 12 of the gear housing.

In the gear housing 2 is found a first planet gear wheel 14 and a second planet gear wheel 16 that each are rotatably suspended on the planet pinion spindles 18, 20, which in turn are releasably fastened to a rotatably suspended planet carrier 22 that via a free-wheeling mechanism 24 interact with a drive shaft 26 extending in a drive shaft housing 28 which is clamped upon the top side 30 of the gear housing 2. The drive shaft 26 includes an internal freewheeling gear wheel 34 in the upwards facing freely projecting end part 32. The planet wheels 14, 16 interact with a toothed rim 33 at the underside of the gear housing 2. The drive shaft housing 28 controls and protects the drive shaft 26 where this is passed up through a hole established and adapted for the purpose 5 in the deck of a boat.

The free-wheeling mechanism 24, which in the embodiment shown in FIG. 1 is constituted by spring-loaded pawls 36 joumalled on the drive shaft 26 and interacting with crest-like cutouts 38 in the planet carrier 22 ensure that the drive shaft is free-wheeling in one direction of rotation, whereby operation of the sheet winch is safeguarded in case of failure of the drive unit, and so that manual operation of the sheet winch does not cause that the shaft of the drive unit is to be driven manually. It is to be mentioned that the free-wheeling mechanism 24 may be designed otherwise than the above described embodiment shown in FIG. 1.

Figure 2:
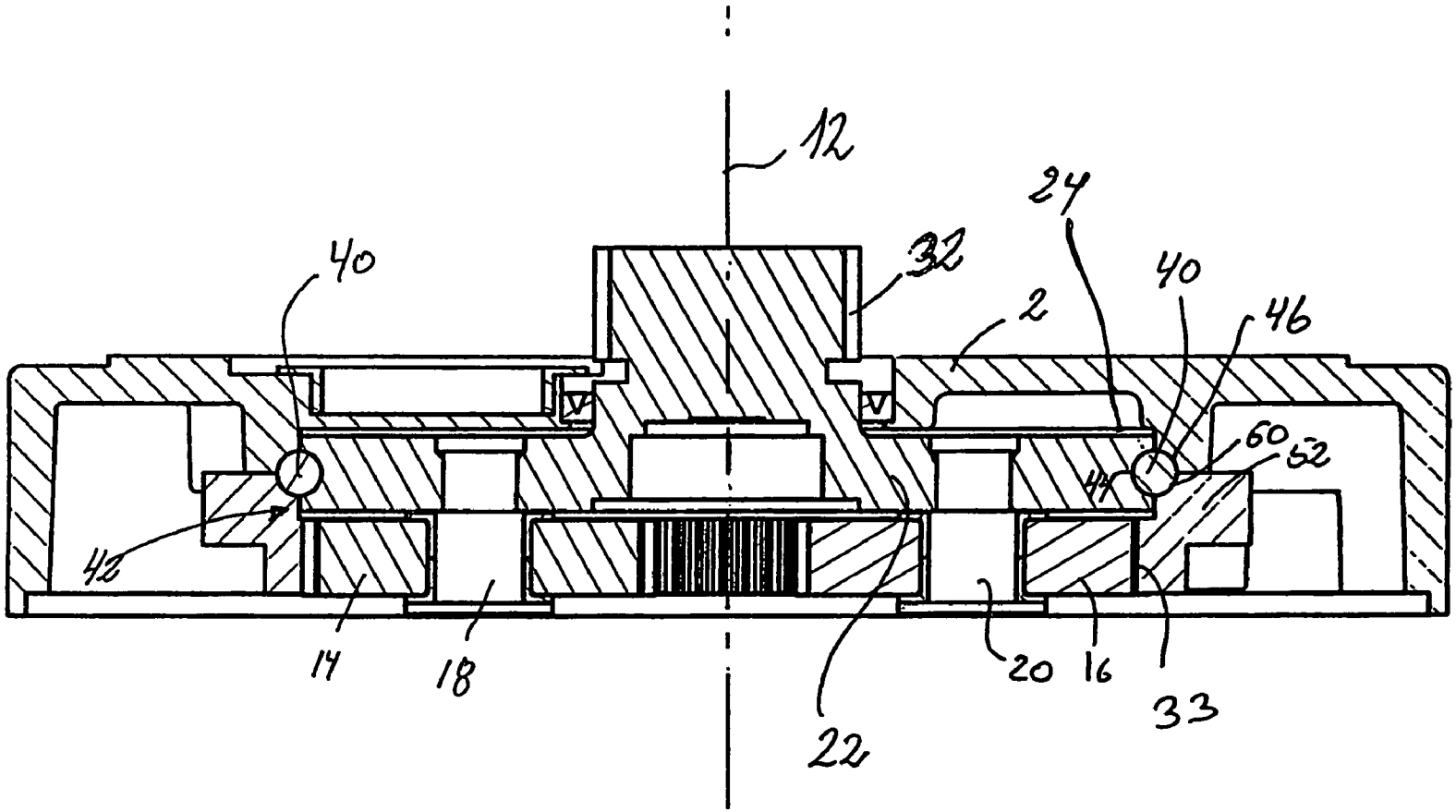
FIG. 2 is a sectional side view of a second embodiment of a gear housing for electric/hydraulic and manually driven sheet winches for mounting on deck.

The peculiar feature of the embodiments of the gear housing 2 shown in FIGS. 1 and 2 is that the suspension of the planet carrier 22 which in the shown embodiments is constituted by balls 40 that are placed in guide grooves 44 on the external periphery 42 of the planet carrier 22 which is disposed farther away from the centre axis 12 of the planet carrier than the cutouts 38 in the planet carrier 22 interacting with the pawls 36 on the free-wheeling mechanism 24. This disposition of the suspension of the planet carrier 22 enables reduction of the constructional height. of the gear housing 2 compared with traditional, prior art planet gears, where the free-wheeling mechanism and the roller/ball bearings for the planet carrier are superposed. Besides, the central shaft is made redundant as a consequence of the ball/roller bearings for the planet carrier are located elsewhere. As it further appears from the embodiments shown in FIGS. 1 and 2, the planet carrier 22 is suspended on roller/ball bearings disposed on the external periphery 42 of the planet carrier which is located farther away from the centre axis 12 of the planet carrier than the attachment points for the planet pinion spindles 18, 20 in the planet carrier 22.

The balls 40 are supported/guided as it appears from the embodiments shown in FIG. 1 in the grooves 44, 46, 48 formed in the external periphery 42 of the planet carrier 22, in the gear housing 2 and in the drive shaft housing 28 where it is in contact with the gear housing.

In the embodiment shown in FIG. 2, the balls 40 are supported/guided in the grooves 44, 46, 50 which are formed in the external periphery 42 of the planet carrier 22, in the gear housing 2 and in a section 52 of the toothed rim 33 that interacts with the planet wheels 14, 16, respectively. In this embodiment, which does not include a drive shaft housing, the toothed rim 33 is retrofitted in a way known per se at the underside of the gear housing 2. This means that the installation height of the gear housing may be further reduced as a result of the planet carrier not needing to be suspended in the area in immediate vicinity of the centre axis 12. Besides, in this embodiment the planet carrier includes a gear wheel 32 as drive wheel for a winch mounted thereupon (not shown), making this embodiment of the invention very suited for mounting upon the deck of a boat.

Figure 3:
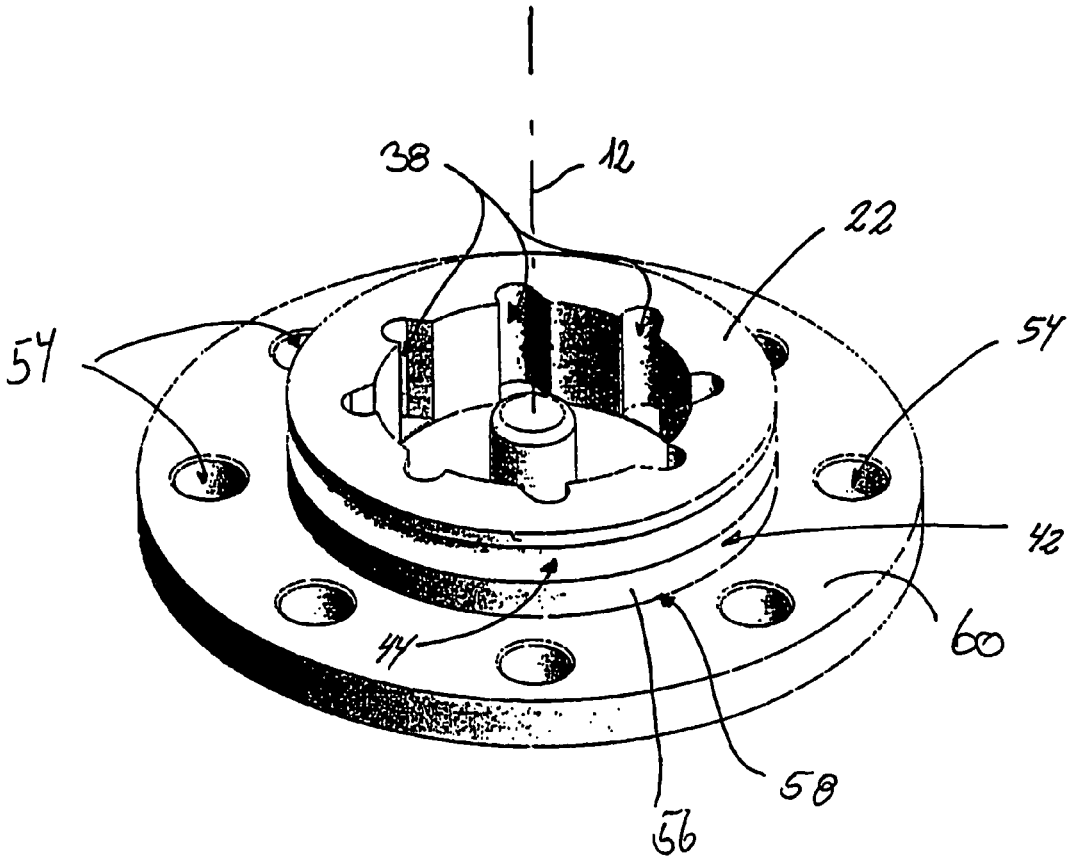
FIG. 3 is a perspective view of a further embodiment of a planet carrier according to the invention for suspending the planet wheels at a greater distance from the centre axis than the bearings of the planet carrier.

In FIG. 3, which is a perspective view of a still further embodiment of the planet carrier 22 according to the invention, the balls (not shown) for the rotatable suspension of the planet carrier 22 are presupposed to be controlled/bome in the groove 44 in the external periphery 42 of an upright section 56 of the planet carrier 22. As it further appears from the shown embodiment of the planet carrier 22, this includes at the underside 58 of the section 56 an annular, projecting flange 60 which is centred about the centre axis/axis of revolution 12. of the planet carrier, the. flange 60 including. holes. 54 disposed with even pitch about the axis of revolution 12 for attaching the planet wheels (not shown). The rotatable bearing of the planet carrier 22 in this embodiment is tus disposed closer to the axis of revolution 12 than the attachment points 54 for the planet wheels 14, 16.

It is to be mentioned that the inventor has realised that the mutual disposition of the bearing of the planet carrier in relation to the free-wheeling unit may vary a little in vertical direction, i.e. the roller/ball bearings for the planet carrier can be placed at level with, slightly above or slightly below the horizontal centre plane of the cutouts 38 in the middle of the planet carrier which interacts with the spring-loaded pawls 36 on the drive shaft 26, but this does not change the inventive aspect of placing the bearing of the planet carrier farther away from the centre axis of the planet carrier than the said cutouts and substantially at the same level as the said cutouts.

The invention claimed is:

1. Gear for electrically/hydraulically and manually driven sheet winches, including a drive shaft housing connected with a gear housing, where the drive shaft housing includes a drive shaft connected with a rotatably suspended planet carrier with a number of planet wheels rotatably suspended on a number of planet pinion spindles corresponding to the number of planet wheels, the planet pinion spindles being anchored in the planet carrier and distributed about a common centre axis for the drive shaft and the planet carrier, where the planet wheels interact with a toothed rim situated at an underside of the gear housing, the drive shaft driven to one-way rotation in a given direction by insertion of a rotor hub interacting with the planet wheels on an electric/hydraulic drive unit, and where between the drive shaft and the planet carrier there is provided a free-wheeling mechanism, characterised in that the planet carrier is suspended on roller/ball bearings disposed farther away from the centre axis of the planet carrier than the free-wheeling mechanism.

2. Gear according to claim 1, characterised in that the planet carrier is suspended on roller/ball bearings disposed on the outer periphery of the planet carrier and farther away from the centre axis of the planet carrier than attachment points for the planet pinion spindles in the planet carrier.

3. Gear according to claim 1, characterised in that the planet carrier is suspended on roller/ball bearings disposed closer to the centre axis of the planet carrier than attachment points of the planet pinion spindles in the planet carrier.

4. Gear according to claim 1, characterised in that the roller/ball bearings for the rotatable suspension of the planet carrier is mainly disposed at the same level as the cutouts in the planet carder interacting with the pawl(s) on the free-wheeling mechanism.

5. Gear according to claim 1, characterised in that rollers/balls constituting one half of the roller/ball bearings on the outer periphery of the planet carrier are guided/carried in grooves formed in the external periphery of the planet carrier, in the gear housing and in the drive shaft housing, respectively, and are disposed at the transition between the gear housing and the drive shaft housing.

6. Gear according to claim 1, characterised in that the rollers/balls constituting one half of the roller/ball bearings on the external periphery of the planet carrier are guided/carried in grooves formed in the external periphery of the planet carrier, in the gear housing and in an extension of a toothed rim and is disposed at the transition between the gear housing and the toothed rim, and that the toothed rim is releasably fastened to the underside of the gear housing.

* * * * *